US011471936B2

(12) United States Patent
Aramaki et al.

(10) Patent No.: US 11,471,936 B2
(45) Date of Patent: Oct. 18, 2022

(54) CONTINUOUS CASTING METHOD OF STEEL

(71) Applicant: JFE Steel Corporation, Tokyo (JP)

(72) Inventors: Norichika Aramaki, Tokyo (JP); Keigo Toishi, Tokyo (JP); Tomoya Odagaki, Tokyo (JP); Keisuke Sano, Tokyo (JP); Shizuhiko Ikeno, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 77 days.

(21) Appl. No.: 17/045,862

(22) PCT Filed: Apr. 12, 2019

(86) PCT No.: PCT/JP2019/015895
§ 371 (c)(1),
(2) Date: Oct. 7, 2020

(87) PCT Pub. No.: WO2019/203137
PCT Pub. Date: Oct. 24, 2019

(65) Prior Publication Data

US 2021/0138535 A1 May 13, 2021

(30) Foreign Application Priority Data

Apr. 17, 2018 (JP) ..... JP2018-078979

(51) Int. Cl.

| | |
|---|---|
| ***B22D 11/12*** | (2006.01) |
| ***B22D 11/128*** | (2006.01) |
| ***B21B 1/02*** | (2006.01) |

(52) U.S. Cl.
CPC ..... *B22D 11/1206* (2013.01); *B21B 1/02* (2013.01); *B22D 11/1282* (2013.01); *B21B 2001/028* (2013.01); *B21B 2201/14* (2013.01)

(58) Field of Classification Search
CPC ... B22D 11/12; B22D 11/1206; B22D 11/128; B22D 11/1282; B22D 11/16; B22D 11/20; B22D 11/207; B21B 1/02; B21B 2001/028; B21B 2201/14
USPC ..... 164/476, 417
See application file for complete search history.

(56) References Cited

FOREIGN PATENT DOCUMENTS

| | | |
|---|---|---|
| CN | 107000045 | 8/2017 |
| EP | 3 219 408 | 9/2017 |
| JP | 8-132203 A | 5/1996 |
| JP | 8-192256 A | 7/1996 |
| JP | 2000-141002 A | 5/2000 |
| JP | 2006-198644 A | 8/2006 |
| JP | 2010-69499 A | 4/2010 |
| JP | 2012-45552 A | 3/2012 |

(Continued)

OTHER PUBLICATIONS

The First Office Action dated Jun. 2, 2021, of counterpart Chinese Application No. 201980025890.2 along with an English translation.

(Continued)

*Primary Examiner* — Kevin P Kerns
(74) *Attorney, Agent, or Firm* — DLA Piper LLP (US)

(57) ABSTRACT

A continuous casting method of steel includes the step of bulging wide side surfaces of a slab having there inside an unsolidified layer with a total intentional bulging amount of 3 to 10 mm by increasing stepwise toward a downstream side in a casting direction a roller gap of a plurality of pairs of slab support rollers disposed in a continuous casting machine.

2 Claims, 3 Drawing Sheets

(56) References Cited

FOREIGN PATENT DOCUMENTS

| | | | |
|---|---|---|---|
| JP | 2015-062918 | A | 4/2015 |
| JP | 2017-24079 | A | 2/2017 |
| JP | 2017-131927 | A | 8/2017 |
| WO | 2018/056322 | A1 | 3/2018 |

OTHER PUBLICATIONS

The Extended European Search Report dated Dec. 9, 2020, of counterpart European Application No. 19788327.5.
Notice of Reasons for Rejection dated Jun. 16, 2020, of counterpart Japanese Application No. 2019-543400, along with a Concise Statement of Relevance of Office Action in English and an English Translation.
Office Action dated Sep. 8, 2020, of counterpart Taiwanese Application No. 108113190, along with a Concise Statement of Relevance of Office Action in English.
Notification of Reason for Refusal dated Oct. 12, 2021, of counterpart Korean Application No. 10-2020-7028818, along with an English Translation and Concise Statement of Relevance of Office Action in English.
Ohnaka, Itsuo, "Computer Dennetsu•Gyoko Kaiseki Nyumon Chuzo Process eno Oyo (Introduction to Heat transfer and Solidification Analysis by Computers Application to Casting Processes)", Maruzen Co., Ltd. (Tokyo), 1985, pp. 201-202.
The European Office Action dated Aug. 11, 2021, of counterpart European Application No. 19788327.5.
The Korean Grant of Patent dated Feb. 7, 2022, of counterpart Korean Patent Application No. 10-2020-7028818, along with an English translation.

CONTINUOUS CASTING METHOD OF STEEL

TECHNICAL FIELD

This disclosure relates to a continuous casting method of steel that suppresses component segregation generated at a thickness central portion, that is, center segregation of a continuously cast slab and can provide a slab showing a good result in hydrogen induced cracking resistance testing and having no internal cracking.

BACKGROUND

In a solidification process of steel, solute elements such as carbon (C), phosphorus (P), sulfur (S), and manganese (Mn) are concentrated in the unsolidified liquid side through redistribution during the solidification. This is micro segregation formed between dendrite arms. Voids are formed or a negative pressure is generated at the thickness central portion of the slab during continuous casting by solidification shrinkage or thermal shrinkage of the slab, bulging of a solidification shell generated between rollers of the continuous casting machine or the like.

When voids are formed or a negative pressure is generated at the thickness central portion of the slab, molten steel is sucked into this portion. Thus, since a sufficient amount of molten steel does not exist in an unsolidified layer at the final stage of the solidification, the molten steel concentrated by the above-described micro segregation flows, gathers at a central portion of the slab, and is solidified. In a segregation spot formed as described above, the concentration of the solute elements is far higher than an initial concentration in the molten steel. This is generally referred to as macro segregation, and because of a part where the macro segregation exists, referred to as center segregation.

The quality of steel materials for line pipes through which crude oil or natural gas is transported are degraded by such center segregation. When manganese sulfide (MnS) or niobium carbide (NbC) is formed in a center segregation portion, hydrogen having entered steel due to corrosion reaction disperses/gathers around the manganese sulfide or the niobium carbide in the steel, and cracking occurs in the steel due to inner pressure of the hydrogen. Furthermore, since the center segregation portion has hardened, the cracking propagates. This cracking is referred to as hydrogen induced cracking (also described as "HIC") and is a main cause of degrading the quality of steel materials used for line pipes in a sour gas environment.

To address this, many measures have been proposed to reduce the center segregation of a slab or render the center segregation of a slab harmless, from a continuous casting process to a rolling process.

For example, Japanese Unexamined Patent Application Publication No. 8-132203 and Japanese Unexamined Patent Application Publication No. 8-192256 propose a method in which a slab at the final stage of solidification having an unsolidified layer is continuously cast in a continuous casting machine, while gradually undergoing rolling reduction with slab support rollers at a rolling reduction amount about a value corresponding to the sum of a solidification shrinkage amount and a thermal shrinkage amount. A technique in which a slab during casting gradually undergoes rolling reduction in the continuous casting machine at a rolling reduction amount about a value corresponding to the sum of a solidification shrinkage amount and a thermal shrinkage amount as described in Japanese Unexamined Patent Application Publication No. 8-132203 and Japanese Unexamined Patent Application Publication No. 8-192256 is referred to as "soft reduction" or a "soft reduction method".

Soft reduction is a technique that reduces the center segregation of the slab in the following manner. That is, the volume of the unsolidified layer is reduced by causing the slab to gradually undergo rolling reduction at a rolling reduction amount corresponding to the sum of a solidification shrinkage amount and a thermal shrinkage amount with a plurality of pairs of rollers arranged in the casting direction to prevent formation of voids or a negative pressure portion in the central portion of the slab and, at the same time, to prevent flowing of concentrated molten steel formed between dendrite arms.

In recent years, continuous casting machines are mainly of a segment type in which a continuous casting machine includes segments that include a plurality of pairs of rollers. In the segment-type continuous casting machine, a rolling reduction roller group (referred to as a "soft reduction zone") that performs soft reduction includes a plurality of segments. In the soft reduction zone including the segments, a predetermined rolling reduction amount is applied to the slab by adjusting a gap of the rollers facing each other such that, on an entry side and an exit side of the segments, the roller gap is larger on the entry side than on the exit side.

Meanwhile, it is known that the shape of the slab at a solidification completion position in a slab width direction is closely related to the center segregation. For example, Japanese Unexamined Patent Application Publication No. 2006-198644 proposes a method in which a solidification completion position in a slab width direction is detected and the flow of molten steel in a casting mold is adjusted or edge side cut off width amount for secondary cooling is adjusted so that the difference between a shortest part and a longest part of the detected solidification completion position is within a standard. When the solidification completion position varies in the slab width direction, a rolling reduction amount in a soft reduction zone varies from position to position in the slab width direction and, at a position where the solidification completion position extends to the downstream side in a casting direction, the rolling reduction amount is reduced, causing a situation in which the effect of improving the center segregation cannot be sufficiently obtained. That technique prevents occurrences of this situation.

It is also known that bulging of the slab between the rollers influences the center segregation. For example, Japanese Unexamined Patent Application Publication No. 2012-45552 proposes a continuous casting method in which bulging of a slab between rollers in a soft reduction zone is calculated by non-steady heat transfer solidification calculation, and a rolling reduction speed applied to the slab is varied in accordance with the calculated bulging between the rollers.

As described above, to improve the center segregation of the slab, measures have been taken for the rolling reduction speed in the soft reduction, the shape of the solidification completion position in the slab width direction, and the bulging between the rollers, respectively. However, currently, the quality level required for continuously cast slabs becomes higher than ever, and variation of the segregation degree in the slab width direction becomes problematic. Particularly, steel materials with exacting segregation requirement such as line pipe steel materials are difficult to be used as line pipe steel materials when there is even only a single portion with large segregation in the width direction at a slab stage.

When the above-described publications are considered from this point of view, there are the following problems.

That is, although the segregation degree in the slab width direction is entirely reduced by the soft reduction according to Japanese Unexamined Patent Application Publication No. 8-132203 and Japanese Unexamined Patent Application Publication No. 8-192256, the effect of improving the segregation is not sufficient when the solidification completion position varies in the slab width direction. The reason for this is that, in a portion where the solidification completion position extends further to the downstream side in the casting direction than other positions in the slab width direction, a portion where the solidification has already been completed becomes a barrier so that the soft reduction is difficult to be applied and, in some instances, hydrogen induced cracking may occur.

According to Japanese Unexamined Patent Application Publication No. 2006-198644, control of the shape of the solidification completion position in the slab width direction is employed as a measure to reduce the segregation. However, the relationship between the shape of the solidification completion position in the slab width direction and a distribution of the segregation in the slab width direction is not clear. Consequently, how to specifically control the shape of the solidification completion position in the slab width direction to reduce the center segregation is not clear. Furthermore, segregation is sufficiently reduced by controlling the difference in length in the casting direction between a shortest solidification completion position and a longest solidification completion position to 2 m or smaller according to Japanese Unexamined Patent Application Publication No. 2006-198644. However, this may not be able to satisfy the recent exacting requirement level of segregation.

According to Japanese Unexamined Patent Application Publication No. 2012-45552, a method is employed in which the rolling reduction speed applied to the slab is varied in accordance with bulging between the rollers calculated by non-steady heat transfer solidification calculation. However, in general, bulging of the slab has already become non-steady bulging that does not return to the original shape by plastic deformation, in the soft reduction zone near the final stage of the solidification. Thus, the entire slab is pushed in at portions in contact with the rollers and the entire slab bulges between the rollers. Since this phenomenon occurs regardless of the rolling reduction speed, no essential improvement is achieved by increasing or reducing the rolling reduction speed. That is, to improve the center segregation of the slab, it is required that the non-steady bulging itself be reduced.

In addition, in the above publications, despite reference to derivation of the soft reduction conditions, no consideration is given to the influence on the soft reduction of a reformation zone and a reformation point of the continuous casting machine that are characteristic of the curved type continuous casting machine and the vertical-bending type continuous casting machine and in which the shape of the slab in the casting direction is reformed from a circular arc shape into a linear shape.

It could therefore be helpful to provide a continuous casting method of steel by which an overall segregation level of center segregation in a slab width direction can be reduced and variation of a segregation degree in the slab width direction can be reduced by considering influence of a reformation zone and a reformation point of a continuous casting machine on a soft reduction.

SUMMARY

We thus provide:

[1] A continuous casting method of steel includes the step of bulging wide side surfaces of a slab having there inside an unsolidified layer with a total intentional bulging amount of 3 to 10 mm by increasing stepwise toward a downstream side in a casting direction a roller gap of a plurality of pairs of slab support rollers disposed in a curved type continuous casting machine or a vertical-bending type continuous casting machine.

The method also includes the step of performing rolling reduction on the wide side surfaces of the slab, performed after the bulging of the wide side surfaces of the slab, in a soft reduction zone in which the roller gap of a plurality of pairs of slab support rollers is reduced stepwise toward the downstream side in the casting direction.

The wide side surfaces of the slab undergo rolling reduction at a rolling reduction speed of 0.3 to 2.0 mm/min with a total rolling reduction amount smaller than or equal to the total intentional bulging amount in the soft reduction zone.

A solid phase fraction at a center of a thickness of the slab is smaller than 0.2, or is greater than or equal to a flow limit solid phase fraction and not greater than 1.0 in a reformation zone in which a shape of the slab in the casting direction is reformed from a circular arc shape into a linear shape.

[2] In the continuous casting method according to [1], a start point of the rolling reduction in the soft reduction zone is a position out of the reformation zone and downstream of the reformation zone in the casting direction.

The solid phase fraction at the slab thickness center is set smaller than 0.2, or is set greater than or equal to the flow limit solid phase fraction and not greater than 1.0 in the reformation zone in which the shape of the slab in the casting direction is reformed from a circular arc shape into a linear shape. Thus, a solidification interface of the slab is not influenced by a tensile force generated when the slab is reformed. As a result, variation of the segregation degree of the center segregation in the slab width direction can be reduced, and the average value of the segregation degree in the slab width direction can be reduced. Furthermore, the slab in which an improved result can be obtained in hydrogen induced cracking resistance testing and in which internal cracking does not occur can be obtained.

REFERENCE SIGNS LIST

Figure 1:
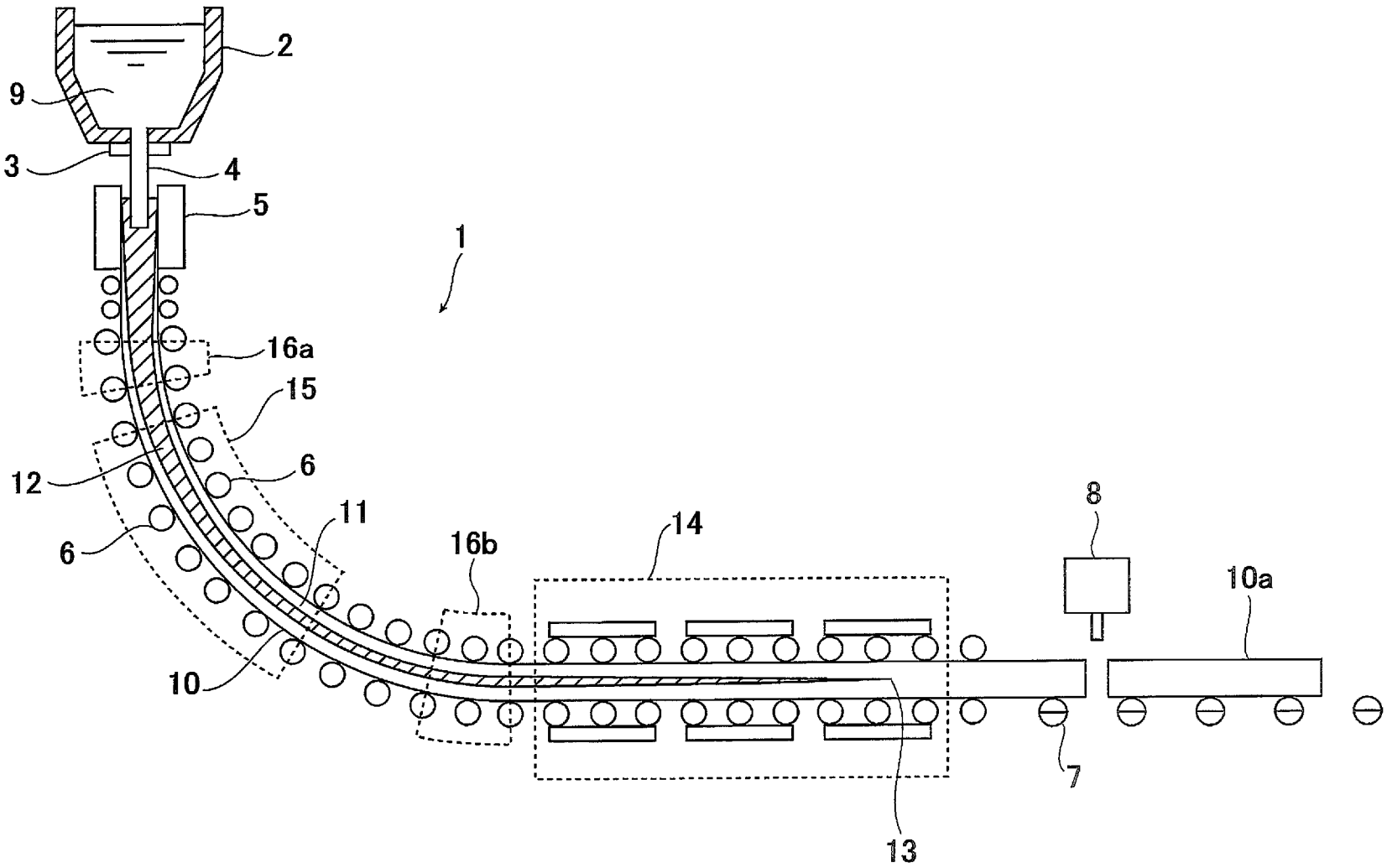
FIG. 1 is a schematic side view of an example of a slab continuous casting machine.

1 slab continuous casting machine
2 tundish
3 sliding nozzle
4 submerged nozzle
5 casting mold
6 slab support roller
7 transport roller
8 slab cutter
9 molten steel
10 slab
11 solidification shell

12 unsolidified layer
13 solidification completion position
14 soft reduction zone
15 intentional bulging zone
16*a* bending zone
16*b* reformation zone

DETAILED DESCRIPTION

Hereinafter, our methods will be specifically described with reference to the accompanying drawings. A continuous casting method of steel is applicable to a curved type continuous casting machine and a vertical-bending type continuous casting machine, and our methods are, in principle, common to the curved type continuous casting machine and the vertical-bending type continuous casting machine. Accordingly, hereinafter, our methods are described, as an example, when the methods are applied to the vertical-bending type continuous casting machine. FIG. 1 is a schematic side view of a vertical-bending type slab continuous casting machine for the methods.

As illustrated in FIG. 1, a casting mold 5 is installed in a vertical-bending type slab continuous casting machine 1. The casting mold 5 is a facility that allows molten steel 9 to be poured therein. The casting mold 5 is used to cool the molten steel 9 to solidify the molten steel 9 and form an outer shell shape of a slab 10 having a rectangular cross section. A tundish 2 is installed at a predetermined position above the casting mold 5. The tundish 2 is used to relay the molten steel 9 supplied from a ladle (not illustrated) to the casting mold 5. A sliding nozzle 3 used to adjust the flow rate of the molten steel 9 is installed at a bottom portion of the tundish 2. A submerged nozzle 4 is installed at a lower surface of the sliding nozzle 3.

Meanwhile, a plurality of pairs of slab support rollers 6 that include support rollers, guide rollers, and pinch rollers are disposed below the casting mold 5. Spray nozzles (not illustrated) such as water spray nozzles or air mist spray nozzles are disposed in spaces between the slab support rollers 6 adjacent to each other in a direction of casting. Thus, a secondary cooling zone is formed in a range from a position immediately below the casting mold to the slab support rollers 6 that are disposed at a machine end. The slab 10 is cooled by secondary cooling water sprayed from the spray nozzles in the secondary cooling zone while being drawn through spaces between the slab support rollers 6 facing each other.

In the vertical-bending type slab continuous casting machine 1, the slab support rollers 6 are arranged side by side in the vertical direction immediately below the casting mold (referred to as a "vertical portion"), and then, the slab support rollers 6 are disposed such that a direction in which the slab 10 is drawn is changed from the vertical direction to a circular arc direction at a position, for example, 1 to 5 m below the position immediately below the casting mold. A portion where the drawing direction of the slab 10 is changed from the vertical direction to the circular arc direction is referred to as a "bending zone" or a "bending point". The "bending zone" is also referred to as an "upper reformation zone", and the "bending point" is also referred to as an "upper reformation point".

A roller group that gradually bends the slab 10 by using a plurality of pairs of the slab support rollers 6 as illustrated in FIG. 1 is referred to as a "bending zone". Rollers where the slab 10 is bent in one go by using a single pair of the slab support rollers 6 are referred to as a "bending point". The functions of the "bending zone" and the "bending point" are the same. We describe a continuous casting machine that includes a bending zone 16*a*.

The slab 10 that has been drawn from the casting mold 5 and has a linear shape in the casting direction is reformed by the bending zone 16*a* into a circular arc shape in the casting direction having a predetermined radius.

When a curved type continuous casting machine is used, an inner space of the casting mold has a circular arc shape, and the shape of the slab in the casting direction drawn from the casting mold is a circular arc shape. Accordingly, neither a bending zone nor a bending point exists in the curved type continuous casting machine.

The slab support rollers 6 disposed downstream of the bending zone 16*a* form an arc of a predetermined radius (referred to as a "curved portion"), and then, change the drawing direction of the slab 10 from the circular arc direction to the horizontal direction (referred to as a "horizontal portion"). A portion where the drawing direction of the slab 10 is changed from the circular arc direction to the horizontal direction is referred to as a "reformation zone" or a "reformation point". The "reformation zone" is also referred to as a "lower reformation zone", and the "reformation point" is also referred to as a "lower reformation point".

A roller group that gradually reforms the slab 10 into a linear shape by using a plurality of pairs of the slab support rollers 6 as illustrated in FIG. 1 is referred to as a "reformation zone". Rollers where the slab 10 is reformed into a linear shape in one go by using a single pair of the slab support rollers 6 are referred to as a "reformation point". The functions of the "reformation zone" and the "reformation point" are the same. We describe a continuous casting machine that includes a reformation zone 16*b*.

The slab 10 that has been drawn from the curving portion and has a circular arc shape in the casting direction undergoes reformation performed by the reformation zone 16*b* so that the shape of the slab 10 is reformed from the circular arc shape into the linear shape in the casting direction.

A plurality of transport rollers 7 that transport the continuously cast slab 10 are installed on the downstream side of the slab support rollers 6 in the casting direction at the last portion in the casting direction. Furthermore, a slab cutter 8 that cuts a slab 10*a* having a predetermined length from the continuously cast slab 10 is disposed above the transport rollers 7.

A soft reduction zone 14 is installed upstream and downstream of a solidification completion position 13 for the slab 10 in the casting direction or upstream of the solidification completion position 13 in the casting direction. The soft reduction zone 14 includes a plurality of pairs of slab support roller groups. A space between the slab support rollers facing each other with the slab 10 interposed therebetween (this space is referred to as a "roller gap") reduces stepwise toward the downstream side in the casting direction. A form in which the roller gap of the slab support rollers 6 is reduced stepwise toward the downstream side in the casting direction for causing the slab 10 to undergo rolling reduction is referred to as a "rolling reduction gradient".

The soft reduction zone 14 can cause the slab 10 to gradually undergo rolling reduction through an entire region or a selected partial region of the soft reduction zone 14 by a rolling reduction amount corresponding to the sum of the solidification shrinkage amount and the thermal shrinkage amount. To reduce center segregation, preferably, the slab 10 undergoes rolling reduction when the solid phase fraction at a thickness center of the slab 10 is in a range greater than or equal to 0.3 but smaller than 0.7.

The lower limit of the solid phase fraction, 0.3, is a solid phase fraction at the thickness center at time when tips of dendrite crystals having grown from solidification shells 11 on an upper surface side and a lower surface side of a slab wide side surfaces are brought into contact with each other at the thickness center of the slab 10. The center segregation is generated by flowing of concentrated molten steel when the solid phase fraction at the thickness center of the slab 10 is 0.3 or greater. Accordingly, even when rolling reduction is started at time when the solid phase fraction at the thickness center exceeds 0.3, the center segregation has already been generated in some instances, and center segregation cannot be sufficiently reduced. The upper limit of the solid phase fraction, 0.7, is the flow limit solid phase fraction of the molten steel 9. When the solid phase fraction becomes greater than or equal to 0.7, the concentrated molten steel does not flow, and the center segregation is not generated. The solid phase fraction at the thickness center of the slab 10 is a solid phase fraction at the thickness center of the slab except for end portions of the slab in the width direction of the slab and can be represented by the solid phase fraction of a portion at the center in the slab width direction and at the thickness center.

Of course, the slab 10 may undergo rolling reduction when the solid phase fraction at the thickness center of the slab 10 is smaller than 0.3 or equal to or greater than 0.7. The solid phase fraction is an index that represents a progression state of solidification from 0 to 1.0. The solid phase fraction=0 (zero) represents a unsolidified state and the solid phase fraction=1.0 represents a completely solidified state.

Spray nozzles are also disposed between the slab support rollers of the soft reduction zone 14 for cooling the slab 10. The slab support rollers 6 disposed in the soft reduction zone 14 are also referred to as "rolling reduction rollers".

In the slab continuous casting machine 1 illustrated in FIG. 1, the soft reduction zone 14 includes three segments that are continuously disposed in the casting direction. Each of the segments includes a set of three pairs of rolling reduction rollers. In FIG. 1, the soft reduction zone 14 includes three segments. However, the soft reduction zone 14 may include a single segment, two segments, or further, four or more segments. Furthermore, although three pairs of the slab support rollers 6 are disposed in a single segment in FIG. 1, the number of pairs of slab support rollers 6 per segment is not necessarily three and may be any number not smaller than two. Furthermore, although it is not illustrated, the slab support rollers 6 other than those in the soft reduction zone 14 are also in segment structures.

Typically, the rolling reduction gradient of the soft reduction zone 14 is represented by the amount of reduction of the roller gap per meter, that is, "mm/m" in the casting direction. Accordingly, a rolling reduction speed (mm/min) of the slab 10 in the soft reduction zone 14 is obtained by multiplying the rolling reduction gradient (mm/m) by a slab drawing speed (m/min).

To suppress the center segregation of the slab 10, it is required that the rolling reduction speed in the soft reduction zone 14 be 0.3 to 2.0 mm/min. When the rolling reduction speed in the soft reduction zone 14 is lower than 0.3 mm/min, the rolling reduction amount per unit time is insufficient. As a result, flowing of concentrated molten steel cannot be suppressed and, accordingly, the center segregation cannot be reduced. In contrast, when the rolling reduction speed in the soft reduction zone 14 exceeds 2.0 mm/min, the rolling reduction amount per unit time becomes excessively large. As a result, concentrated molten steel at a central portion of the slab is pushed out toward the upstream side in the casting direction and, accordingly, non-segregation in which the solute elements are reduced is generated at the central portion of the slab.

The slab support rollers 6 disposed between the lower end of the casting mold 5 and a liquidus crater end position of the slab 10 are included in an intentional bulging zone 15. In the intentional bulging zone 15, the roller gap of the slab support rollers 6 is set such that the roller gap increases stepwise every roller or every a few to several rollers toward the downstream side in the casting direction until an increased amount of the roller gap reaches a predetermined value. The intentional bulging is started at a stage where the solid phase fraction at the slab thickness center is 0 (zero) and continued until the total amount of the intentional bulging of the slab wide side surfaces reaches 3 to 10 mm. The total amount of the intentional bulging of the slab wide side surfaces from the start of the intentional bulging to the end of the intentional bulging in the intentional bulging zone 15 is referred to as a "total intentional bulging amount".

The roller gap of the slab support rollers 6 installed downstream of the intentional bulging zone 15 is uniform or narrowed by about a value corresponding to the amount of shrinkage occurring due to reduction in temperature of the slab 10. Then the slab support rollers 6 continue to the soft reduction zone 14 on the downstream side.

Figure 2:
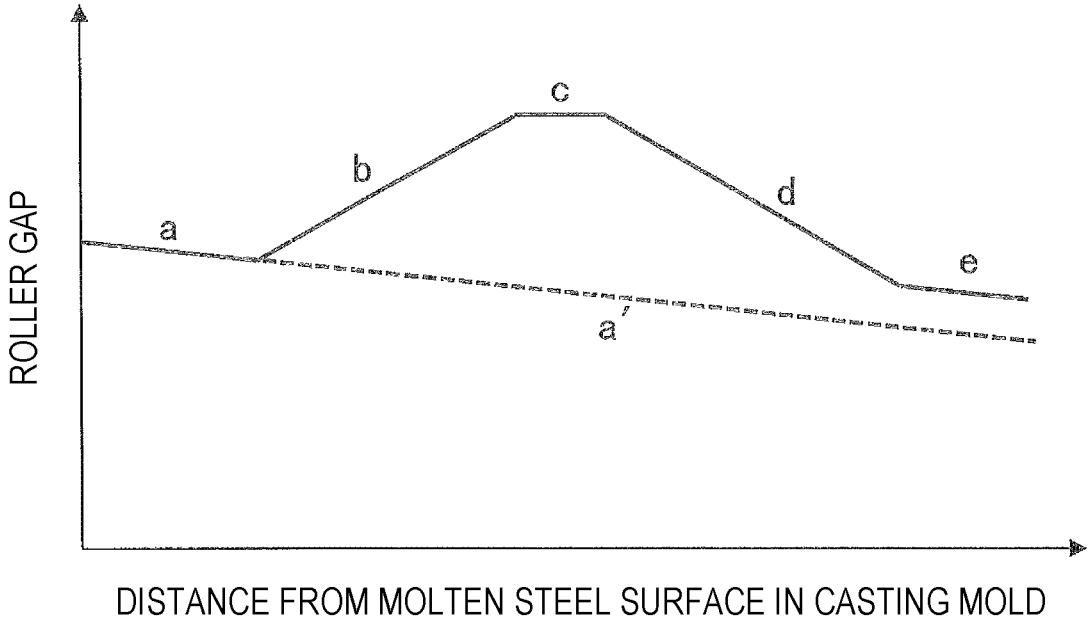
FIG. 2 is a diagram illustrating an example of a profile of a roller gap of slab support rollers.

FIG. 2 illustrates an example of a profile of the roller gap of the slab support rollers. As illustrated in FIG. 2, the slab wide side surfaces are intentionally bulged by ferro-static pressure in the intentional bulging zone 15 to increase the thickness of the wide side surfaces of the slab 10 except for regions near the narrow sides (region b). On the downstream side past the intentional bulging zone 15, the roller gap is uniform or narrowed by about a value corresponding to the shrinkage amount occurring due to reduction in temperature of the slab 10 (region c). After that, the slab wide side surfaces undergo rolling reduction in the soft reduction zone 14 according to the profile (region d). In FIG. 2, a and e are regions where the roller gap is narrowed by about a value corresponding to the shrinkage amount occurring due to reduction in temperature of the slab 10. Furthermore, in FIG. 2, a' is an example of a related-art roller gap in which the roller gap is narrowed by about a value corresponding to the shrinkage amount occurring due to reduction in temperature of the slab 10.

In the intentional bulging zone 15, the roller gap of the slab support rollers 6 is sequentially enlarged toward the downstream side in the casting direction. As a result, the wide side surfaces of the slab 10 except for regions near the narrow sides are intentionally bulged, by the ferro-static pressure due to an unsolidified layer to follow the slab support rollers 6. Since the regions near the narrow sides of the slab wide side surfaces are firmly held and constrained by the slab narrow side surfaces having been solidified, the thickness at the start of the intentional bulging is maintained. Accordingly, out of the slab 10, only part of the slab wide side surfaces having been bulged by the intentional bulging is brought into contact with the slab support rollers 6.

Furthermore, in the soft reduction zone 14, by setting a total rolling reduction amount to a value smaller than or equal to a total intentional bulging amount, only bulged part of the slab wide side surfaces undergoes rolling reduction. This allows the slab 10 to efficiently undergo rolling reduction. The term "total rolling reduction amount" refers to a rolling reduction amount by which the slab 10 undergoes rolling reduction from the start to end of the rolling reduction in the soft reduction zone 14.

In the slab continuous casting machine 1 having this structure, the molten steel 9 poured from the tundish 2 to the casting mold 5 through the submerged nozzle 4 is cooled by the casting mold 5, thereby forming the solidification shells 11. The slab 10 shells of which are these solidification shells 11 and which includes an unsolidified layer 12 therein is continuously drawn to a region below the casting mold 5 while being supported by the slab support rollers 6 provided below the casting mold 5. The shape of the slab 10 in the casting direction is reformed from a linear shape into a circular arc shape in the bending zone 16*a* and from the circular arc shape into the linear shape in the reformation zone 16*b*. Furthermore, the slab 10 is cooled by the secondary cooling water of the secondary cooling zone while passing through the slab support rollers 6, thereby the thickness of the solidification shells 11 is increased. In the intentional bulging zone 15, the thickness of part of the slab wide side surfaces of the slab 10 except for the narrow side end portions is increased, and, in the soft reduction zone 14, solidification of the slab 10 including the inside thereof is completed at the solidification completion position 13 while undergoing rolling reduction. The slab 10 having been solidified is cut by the slab cutter 8 and becomes the slab 10*a*. Mold powder (not illustrated) that functions as a heat insulator, a lubricant, an antioxidant and the like is added into the casting mold.

Figure 3:
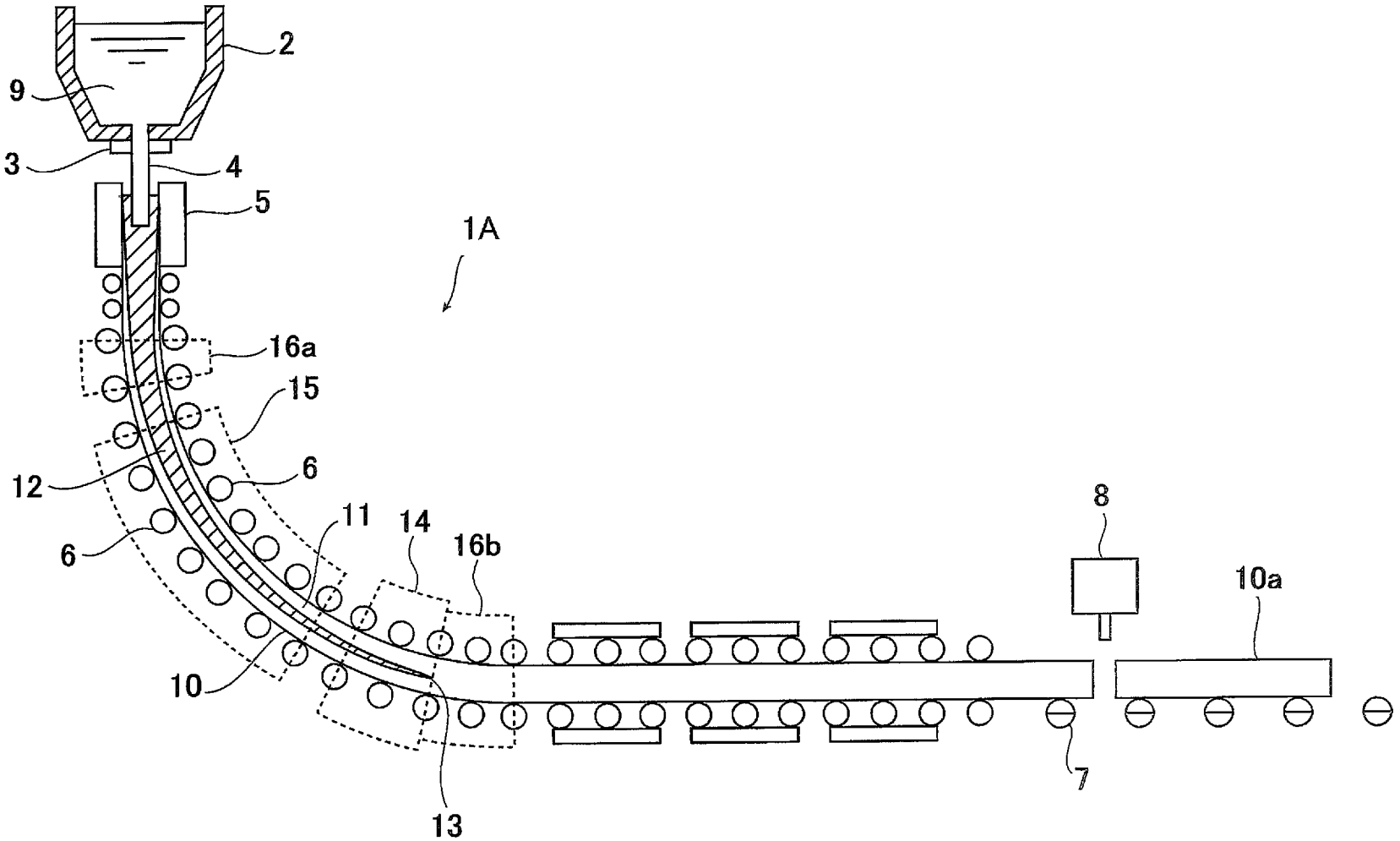
FIG. 3 is a schematic side view of another example of the slab continuous casting machine.

In the slab continuous casting machine 1 illustrated in FIG. 1 used for the above description, the intentional bulging zone 15, the reformation zone 16*b*, and the soft reduction zone 14 are sequentially installed in this order from the upstream side in the casting direction, and solidification of the slab 10 is completed in the horizontal portion of the slab continuous casting machine 1. Our methods are not limited to the slab continuous casting machine 1 having this structure and can be applied to a slab continuous casting machine in which the intentional bulging zone 15, the soft reduction zone 14, and the reformation zone 16*b* are sequentially installed in this order from the upstream side in the casting direction. FIG. 3 illustrates a schematic side view of a slab continuous casting machine 1A in which the intentional bulging zone 15, the soft reduction zone 14, and the reformation zone 16*b* are sequentially installed in this order from the upstream side in the casting direction.

Although the soft reduction zone 14 is installed upstream of the reformation zone 16*b* in the slab continuous casting machine 1A in the casting direction illustrated in FIG. 3, other structures of the slab continuous casting machine 1A are the same as those of the slab continuous casting machine 1 illustrated in FIG. 1. Portions of the same structures are denoted by the same reference signs, thereby description thereof is omitted. In this slab continuous casting machine 1A, the slab 10 undergoes rolling reduction performed by the soft reduction zone 14 installed in a curved portion of the slab continuous casting machine 1A, and then, the shape of the slab 10 in the casting direction is reformed by the reformation zone 16*b* from a circular arc shape into a linear shape. Solidification of the slab 10 is completed within the soft reduction zone 14 or immediately downstream of the soft reduction zone 14.

We considered the influence of stress generated in reformation of the slab 10 in the reformation zone 16*b* on segregation of the slab 10 as follows.

In the reformation zone 16*b*, out of solidification interfaces of the curved portion that face each other in the slab thickness direction, a tensile force in a slab drawing direction acts on a solidification interface on a curve inner side, and compressive stress in the slab drawing direction acts on a solidification interface on a curve outer side. We believe that, at positions where the tensile force in the slab drawing direction acts on the solidification interface on the curve inner side, the tensile force is released as follows: at a certain position of the solidification interface, the solid phase near the solidification interface is uniformly elongated in the slab drawing direction to release the tensile force; and at another position of the solidification interface, cracking occurs in the solidification interface to release the tensile force. We also believe that, as a result, molten steel with the concentrated solute elements flows into particularly a portion where cracking occurs in the solidification interface, and then, is solidified. That is, the center segregation varies in the slab width direction due to the tensile force during the reformation.

When the slab 10 has already been solidified by the reformation zone 16*b*, that is, when the solid phase fraction is 1.0 at the slab thickness center in the reformation zone 16*b*, there is no influence of reformation stress on the solidification interface, and the reformation stress does not cause the center segregation to vary in the slab width direction. Likewise, also when the solid phase fraction at the slab thickness center in the reformation zone 16*b* is greater than or equal to the flow limit solid phase fraction (0.7), there is no influence of reformation stress on the solidification interface, and the reformation stress does not cause the center segregation to vary in the slab width direction.

To investigate the influence of stress applied to the slab 10 on the center segregation during passage of the slab 10 through the reformation zone 16*b* of the slab continuous casting machine 1, continuous casting was performed with the solid phase fraction varied at the slab thickness center in the reformation zone 16*b*. The degree of Mn segregation of the obtained slab 10 was investigated, and the obtained slab 10 underwent hydrogen induced cracking resistance testing (HIC testing) of a steel sheet formed by hot rolling the obtained slab 10 (levels 1 to 9). As the casting conditions, the rolling reduction speed in the soft reduction zone 14 was 0.50 mm/min, and the total intentional bulging amount was 5.0 mm except for level 9. The intentional bulging was not performed for level 9. The solid phase fraction at the slab thickness center was adjusted by varying the amount of the secondary cooling water with the slab drawing speed fixed. The solidification completion position 13 was obtained by using heat transfer solidification calculation. As a method of the heat transfer solidification calculation, numerical calculation can be performed by using, for example, an "enthalpy method" described in, for example, OHNAKA, Itsuo, "Computer Dennetsu•Gyoko Kaiseki Nyumon Chuzo Process eno Oyo (Introduction to Heat transfer and Solidification Analysis by Computers Application to Casting Processes)", Maruzen Co., Ltd. (Tokyo), 1985, pp. 201-202.

Table 1 provides the casting conditions and results of the investigation. The solid phase fraction at the slab thickness center in the reformation zone provided in Table 1 indicates the solid phase fraction on the entry side of the reformation zone 16*b* (lower value) and the solid phase fraction on the exit side of the reformation zone 16*b* (higher value).

TABLE 1

| Level | Set rolling reduction speed (mm/min) | Actual rolling reduction speed (mm/min) | Total rolling reduction amount (mm) | Total intentional bulging amount (mm) | Solid phase fraction at slab thickness center in reformation zone (fs) | Average Mn segregation degree in slab width ($C/C_0$_Mn) | Max. Mn segregation degree in slab width ($C/C_0$_Mn) | Max./Average Mn segregation degree in width | HIC result (CAR: %) | Remarks |
|---|---|---|---|---|---|---|---|---|---|---|
| 1 | 0.50 | 0.46 | 4.0 | 5.0 | 0-0.1 | 1.051 | 1.054 | 1.003 | 0 | Inventive example |
| 2 | 0.50 | 0.47 | 4.0 | 5.0 | 0 | 1.053 | 1.058 | 1.005 | 0.2 | Inventive example |
| 3 | 0.50 | 0.47 | 2.6 | 5.0 | 1.0 | 1.054 | 1.057 | 1.003 | 0.1 | Inventive example |
| 4 | 0.50 | 0.49 | 4.0 | 5.0 | 0-0.15 | 1.058 | 1.062 | 1.004 | 0.8 | Inventive example |
| 5 | 0.50 | 0.47 | 4.0 | 5.0 | 0-0.3 | 1.058 | 1.078 | 1.019 | 3.2 | Comparative example |
| 6 | 0.50 | 0.48 | 4.0 | 5.0 | 0.1-0.5 | 1.068 | 1.116 | 1.045 | 15.8 | Comparative example |
| 7 | 0.50 | 0.49 | 4.0 | 5.0 | 0.2-0.7 | 1.072 | 1.110 | 1.035 | 12.6 | Comparative example |
| 8 | 0.50 | 0.48 | 4.0 | 5.0 | 0.3-0.8 | 1.070 | 1.125 | 1.051 | 17.1 | Comparative example |
| 9 | 0.50 | 0.42 | 4.0 | 0 | 0-0.15 | 1.060 | 1.082 | 1.021 | 1.9 | Comparative example |

Heats 1, 2, 4 were testing in which the solid phase fraction at the slab thickness center in the reformation zone 16*b* was adjusted to a value smaller than 0.2. A maximum value of the Mn segregation degree in the slab width was 1.062 or smaller, and the CAR (crack area ratio) in the hydrogen induced cracking resistance testing was 0.8% or smaller. Thus, the Mn segregation degree and the hydrogen induced cracking resistance testing were good. Level 3 was testing in which the solid phase fraction at the slab thickness center was adjusted to 1.0. The Mn segregation degree and the hydrogen induced cracking resistance testing were good.

In contrast, in levels 5 to 9 including ranges in which the solid phase fraction at the slab thickness center in the reformation zone 16*b* was greater than or equal to 0.2 and smaller than the flow limit solid phase fraction, the Mn segregation degree and the hydrogen induced cracking resistance testing clearly were aggravated compared to levels 1 to 4. Furthermore, in level 9 in which the intentional bulging was not performed, the Mn segregation degree and the hydrogen induced cracking resistance testing were aggravated compared to those in levels 1 to 4. In levels 5 and 9, average values of the Mn segregation degree in the slab width were respectively 1.058 and 1.060 which are the same level as that in level 4. However, maximum values of the Mn segregation degree in the slab width were aggravated.

Furthermore, in levels 5 to 9, the values of the maximum value/average value of the Mn segregation degree in the slab width were significantly aggravated compared to those in levels 1 to 4. Thus, variation of the segregation degree of the center segregation in the slab width direction can be reduced by adjusting the solid phase fraction at the slab thickness center in the reformation zone 16*b* to a value smaller than 0.2 or to 1.0. The Mn segregation degree is good when both the average value and the maximum value in the slab width is greater than 1.06 or smaller. The CAR of the HIC testing is good when 2.0% or smaller.

From these results, we found that, to reduce the center segregation of the slab 10, continuous casting is required to be performed, in the reformation zone 16*b*, by controlling the solid phase fraction at the slab thickness center to a value smaller than 0.2, or by controlling the solid phase fraction at the slab thickness center to a value greater than or equal to the flow limit solid phase fraction and not greater than 1.0.

Thus, the solid phase fraction at the thickness center of the slab 10 is required to be smaller than 0.2, or required to be greater than or equal to the flow limit solid phase fraction and not greater than 1.0 in the reformation zone 16*b* in which the shape of the slab 10 in the casting direction is reformed from a circular arc shape into a linear shape.

In the Remarks column of Table 1, testing is indicated as "Inventive example", testing other than that is indicated as "Comparative example".

Furthermore, reformation stress at the solidification interface is reduced by setting the solid phase fraction at the slab thickness center in the reformation zone 16*b* to smaller than 0.2. This can reduce variation of the segregation degree in the slab width direction due to the center segregation and prevent cracking in the solidification interface and flowing of molten steel. Thus, the segregation degree of the center segregation can be reduced.

Furthermore, when soft reduction is performed in the reformation zone 16*b*, stress due to the soft reduction may occur in the solidification interface to promote segregation. Accordingly, it is preferable that performing of the soft reduction on the slab 10 be avoided in the reformation zone 16*b*. That is, the casting conditions are preferably set so that the start point of rolling reduction in the soft reduction zone 14 is a position out of the reformation zone 16*b* and downstream of the reformation zone 16*b* in the casting direction.

The intentional bulging zone 15 is preferably disposed between the lower end of the casting mold 5 and the liquidus crater end position of the slab 10. That is, the bulging is preferably intentionally performed in a region where the solid phase fraction at the slab center is 0 (zero). The reason for this is that the slab thickness central portion is entirely the unsolidified layer 12 (liquid) and the solidification shells 11 of the slab 10 are high in temperature and small in deformation resistance in a region upstream of the liquidus crater end position of the slab 10 in the casting direction and, accordingly, bulging can be easily performed. Furthermore, for intentionally bulging the slab 10, the center segregation is instead aggravated when bulging is performed at time when the amount of the unsolidified layer 12 existing in the slab 10 is small. However, when the bulging is performed in a region upstream of the liquidus crater end position of the slab 10 in the casting direction, a large amount of molten steel of an initial concentration in which the solute elements have not been concentrated exists in the slab, and this molten steel easily flows at this time. Flowing of this molten steel does not cause segregation and, accordingly, bulging at this time does not cause the center segregation.

The liquidus of the slab 10 is a solidification start temperature determined by the chemical composition of the slab 10 and, can be obtained by, for example, expression (1) below.

$$TL=1536-(78\times[C\ \%]+7.6\times[Si\ \%]+4.9\times[Mn\ \%]+34.4\times[P\ \%]+38\times[S\ \%]+4.7\times[Cu\ \%]+3.1\times[Ni\ \%]+1.3\times[Cr\ \%]+3.6\times[Al\ \%]) \quad (1).$$

In expression (1), TL is a liquidus temperature (° C.), [C %] is the concentration of carbon in the molten steel (mass %), [Si %] is the concentration of silicon in the molten steel (mass %), [Mn %] is the concentration of manganese in the molten steel (mass %), [P %] is the concentration of phosphorus in the molten steel (mass %), [S %] is the concentration of sulfur in the molten steel (mass %), [Cu %] is the concentration of copper in the molten steel (mass %), [Ni %] is the concentration of nickel in the molten steel (mass %), [Cr %] is the concentration of chromium in the molten steel (mass %), and [Al %] is the concentration of aluminum in the molten steel (mass %).

Although our methods are discussed with an aluminum killed carbon steel containing C: 0.03 to 0.2 mass %, Si: 0.05 to 0.5 mass %, Mn: 0.8 to 1.8 mass %, P: smaller than 0.02 mass %, and S: smaller than 0.005 mass %, the scope of this disclosure is not limited.

The liquidus crater end position of the slab 10 can be obtained by checking the temperature gradient in the slab obtained by the heat transfer solidification calculation and the liquidus temperature determined by expression (1) against each other.

No special mechanism is required for the intentional bulging zone 15. The intentional bulging zone 15 is configured only by adjusting the roller gap. Accordingly, the intentional bulging zone 15 can be installed at any position as long as this position is in a range from the lower end of the casting mold 5 to the liquidus crater end position of the slab 10.

Load applied to the segments included in the soft reduction zone 14 (also referred to as "soft reduction segments") is determined based on the size of the slab 10, the rolling reduction gradient in the soft reduction zone 14, and the ratio of the unsolidified layer 12 in the slab 10 during rolling reduction. To prevent flowing of the molten steel at the final stage of the solidification that causes the center segregation, it is required that rolling reduction be applied by an amount corresponding to the solidification shrinkage amount and the thermal shrinkage amount. When the set rolling reduction gradient is large or the size of the slab is large, the load applied to the soft reduction segments increases.

When the load applied to the soft reduction segments increases, the roller gap in the soft reduction segments is enlarged. Accordingly, even when the sizes of the slab and the setting of the rolling reduction gradient are the same, the load applied to the soft reduction segments varies in accordance with the shape in the slab width direction at the solidification completion position 13, and the roller gap also varies in accordance with this load. Thus, the rolling reduction speed actually applied to the slab 10 also varies from the set value. Furthermore, the increase in load to the soft reduction segments may reduce life of roller bearing portions of the soft reduction segments. Accordingly, it is important to set the rolling reduction gradient and the slab drawing speed in accordance with the size of the slab with consideration of these.

Specifically, there are the following two examples depending on the positional relationship of the solidification completion position 13 relative to the reformation zone 16*b*. In the first example, the solidification completion position 13 is upstream of the reformation zone 16*b* in the casting direction. In the second example, the solidification completion position 13 is downstream of the reformation zone 16*b* in the casting direction. The second example is more preferable than the first example.

The reason for this is that the solidification completion position 13 can be further to the downstream side in the second example. That is, because productivity can be improved by increasing the slab drawing speed. Another reason for this is that, since a reformation reactive force of the slab in the reformation zone 16*b* tends to reduce as the thickness of the solidification shells reduces, cracking in the solidification interface of the slab can be reduced in the reformation zone 16*b*.

Another reason for this is that the reformation reactive force of the slab reduces as the thickness of the solidification shells reduces. Actually, when complete solidification occurs upstream of the reformation zone 16*b* and when complete solidification occurs downstream of the reformation zone 16*b* are compared to the length of casting time fixed, the life of the bearings of the roller segments included in the reformation zone 16*b* increases by 10% when complete solidification occurs downstream of the reformation zone 16*b*.

As has been described, the solid phase fraction at the slab thickness center is set smaller than 0.2, or is set greater than or equal to the flow limit solid phase fraction and not greater than 1.0 in the reformation zone 16*b* in which the shape of the slab 10 in the casting direction is reformed from a circular arc shape into a linear shape. Thus, the solidification interface of the slab is not influenced by the tensile force generated when the slab is reformed. As a result, variation of the segregation degree of the center segregation in the slab width direction can be reduced, and the average value of the segregation degree in the slab width direction can be reduced.

Examples

To efficiently perform soft reduction on the slab 10, we conducted testing in which the slab 10 having a width of 2100 mm and a thickness of 250 mm was cast (levels 101 to 113). In the testing, the slab drawing speed was fixed to 1.1 m/min, and the total intentional bulging amount in the intentional bulging zone 15 and the rolling reduction speed in the soft reduction zone 14 were varied. Influence of the total intentional bulging amount, the rolling reduction speed, and the total rolling reduction amount on the quality of the slab was investigated. The solid phase fraction at the slab thickness center in the reformation zone 16*b* was set to 0 to 0.1.

The Mn segregation degree of the obtained slab 10 was investigated, and the obtained slab 10 underwent hydrogen induced cracking resistance testing. Table 2 provides the casting conditions and results of the investigation.

TABLE 2

| Level | Set rolling reduction speed (mm/min) | Actual rolling reduction speed (mm/min) | Total rolling reduction amount (mm) | Total intentional bulging amount (mm) | Segregation morphology | Internal cracking | Average Mn segregation degree in slab width ($C/C_0$_Mn) | Max. Mn segregation degree in slave width ($C/C_0$_Mn) | Max./Average Mn segregation degree in width | HIC result (CAR: %) | Remarks |
|---|---|---|---|---|---|---|---|---|---|---|---|
| 101 | 0.50 | 0.45 | 2.5 | 3.0 | — | No | 1.052 | 1.059 | 1.007 | 1.1 | Inventive example |
| 102 | 0.50 | 0.45 | 4.5 | 5.0 | — | No | 1.053 | 1.057 | 1.004 | 0.5 | Inventive example |
| 103 | 0.50 | 0.47 | 6.5 | 7.0 | — | No | 1.054 | 1.058 | 1.004 | 0.1 | Inventive example |
| 104 | 0.50 | 0.48 | 9.5 | 10.0 | — | No | 1.055 | 1.057 | 1.002 | 0 | Inventive example |
| 105 | 1.00 | 0.95 | 2.5 | 3.0 | — | No | 1.051 | 1.055 | 1.004 | 0 | Inventive example |
| 106 | 2.00 | 1.94 | 2.5 | 3.0 | — | No | 1.048 | 1.053 | 1.005 | 0 | Inventive example |
| 107 | 0.50 | 0.47 | 9.0 | 10.5 | — | Yes | 1.056 | 1.058 | 1.002 | 0 | Comparative example |
| 108 | 0.50 | 0.47 | 14.0 | 15.0 | — | Yes | 1.049 | 1.054 | 1.005 | 0 | Comparative example |
| 109 | 0.50 | 0.12 | 2.5 | 0 | V segregation | No | 1.070 | 1.092 | 1.021 | 11.2 | Comparative example |
| 110 | 0.50 | 0.14 | 3.5 | 2.5 | V segregation | No | 1.072 | 1.100 | 1.026 | 9.4 | Comparative example |
| 111 | 0.30 | 0.20 | 4.0 | 3.0 | V segregation | No | 1.078 | 1.089 | 1.010 | 5.2 | Comparative example |
| 112 | 4.00 | 3.85 | 4.8 | 5.0 | Inverse V segregation | No | 1.068 | 1.078 | 1.009 | 7.1 | Comparative example |
| 113 | 3.00 | 2.94 | 2.5 | 3.0 | Inverse V segregation | No | 1.065 | 1.082 | 1.016 | 5.8 | Comparative example |

In the testing, the total intentional bulging amount in the intentional bulging zone 15 was varied in a range of 0 to 15 mm.

In levels 101 to 108, 112, 113, the total rolling reduction amount in the soft reduction zone 14 was set to be smaller than the total intentional bulging amount to not cause the narrow sides of the slab 10 where solidification had been completed to undergo rolling reduction during the soft reduction. In contrast, in levels 109, 110, 111, the total rolling reduction amount in the soft reduction zone 14 was set to be larger than the total intentional bulging amount.

Furthermore, the solidification completion position 13 was obtained in advance by the heat transfer solidification calculation, and displacement of the roller gap was measured during continuous casting by a contactless sensor in the most downstream soft reduction segment in the casting direction in which the solidification completion position 13 exists.

As a result of the measurement of the displacement of the roller gap, in levels 109 and 110 in which the total intentional bulging amount was smaller than 3 mm, the narrow sides of the completely solidified slab 10 underwent the rolling reduction during the rolling reduction in the soft reduction zone 14. Thus, the load to the soft reduction segments became excessive, and the rolling reduction could hardly be performed on the slab 10. Accordingly, in levels 109 and 110, the actual rolling reduction speed was significantly reduced compared to the set rolling reduction speed.

In contrast, in levels 107 and 108 in which the total intentional bulging amount exceeded 10 mm, internal cracking occurred in the slab 10.

From these results, we found that the total intentional bulging amount in the intentional bulging zone 15 is required to be set to 3 to 10 mm.

After the continuous casting, the cross sections of test pieces extracted from the obtained slab (corresponding to the longitudinal cross section of the slab) were corroded by a picric acid and checked whether there was V segregation or inverse V segregation or internal cracking. Furthermore, in each of the test pieces extracted from the slab, the segregation of Mn at the slab thickness central portion was analyzed with an electron probe micro analyzer (EPMA), thereby investigating the Mn segregation degree at various positions in the slab width direction. A method of investigating the Mn segregation degree is as follows.

The test piece was extracted such that, in the cross section of the slab perpendicular to the slab drawing direction, the test piece has a width of 15 mm, includes a center segregation portion at a central portion, and the length thereof is from the center in the width to a triple junction on the one side (a point where narrow side solidifying shells and wide side solidifying shells have grown and met). The cross sections of the slab of extracted test piece perpendicular to the slab drawing direction were polished, the surface was corroded by, for example, a picric acid saturated aqueous solution or the like to reveal segregated grains, and the center segregation portion was set as a ±7.5 mm range from the center of the segregation zone in the slab thickness direction.

The test piece of the segregation zone (a region near the solidification completion position) near the slab thickness center was divided into small pieces in the slab width direction. Then, a surface analysis of the Mn concentration was performed on the entire surface at an electron beam diameter of 100 μm with the electron probe micro analyzer. The Mn segregation degree is a value obtained by dividing the concentration at the Mn segregation portion by the Mn concentration at a position separated by 10 mm from the thickness central portion in the slab thickness direction.

Furthermore, the hydrogen induced cracking resistance testing was performed on the test pieces extracted from various positions in the slab width direction. Based on these results, the relationship between the rolling reduction speed actually applied to the slab 10 and the segregation of the slab 10 was evaluated.

As a result, the V segregation was generated in levels 109, 110, 111 in which the rolling reduction speed in the soft reduction zone 14 was slower than 0.3 mm/min and, in contrast, the inverse V segregation was generated in levels 112, 113 in which the rolling reduction speed was higher than 2.0 mm/min.

In the testing in which the V segregation or the inverse V segregation was generated, the Mn segregation degree was aggravated and the CAR of the hydrogen induced cracking resistance testing was also aggravated. As described above, the Mn segregation degree of not greater than 1.06 is good and the CAR of the hydrogen induced cracking resistance testing of not greater than 2.0% is good.

Accordingly, we found that it is required that the rolling reduction speed in the soft reduction zone 14 be controlled to 0.3 to 2.0 mm/min. The rolling reduction speed actually applied to the slab 10 is obtained by multiplying the rolling reduction gradient calculated from the measured value of the roller gap in the soft reduction segment with the contactless sensor by the slab drawing speed.

The invention claimed is:

1. A method of continuous casting of steel, the method comprising:

dispensing molten steel into a continuous casting mold and solidifying the molten steel to form a slab including a solidified shell and an unsolidified central layer;

intentionally bulging wide side surfaces of the slab having there inside the unsolidified layer with a total intentional bulging amount of 3 to 10 mm by increasing stepwise toward a downstream side in a casting direction a roller gap of a plurality of pairs of slab support rollers disposed in a curved continuous casting machine or a vertical-bending continuous casting machine; and after bulging the wide side surfaces of the slab, performing rolling reduction on the wide side surfaces of the slab in a soft reduction zone in which the roller gap of a plurality of pairs of slab support rollers is reduced stepwise toward the downstream side in the casting direction; wherein the wide side surfaces of the slab undergo rolling reduction at a rolling reduction speed of 0.3 to 2.0 mm/min with a total rolling reduction amount smaller than or equal to the total intentional bulging amount in the soft reduction zone, and a solid phase fraction at a center of a thickness of the slab is smaller than 0.2, or is greater than or equal to a flow limit solid phase fraction and not greater than 1.0 in a reformation zone in which a shape of the slab in the casting direction is reformed from a circular arc shape into a linear shape.

2. The method according to claim 1, wherein a start point of the rolling reduction in the soft reduction zone is a position out of the reformation zone and downstream of the reformation zone in the casting direction.

* * * * *